US011358830B1

(12) United States Patent
Dewberry et al.

(10) Patent No.: US 11,358,830 B1
(45) Date of Patent: Jun. 14, 2022

(54) ROBOTIC SPOOLER

(71) Applicant: Southwire Company, LLC, Carrollton, GA (US)

(72) Inventors: Jeffrey Neal Dewberry, Tallapoosa, GA (US); Kenneth Heifner, Bremen, GA (US); Patrick Slaughter, Carrollton, GA (US)

(73) Assignee: SOUTHWIRE COMPANY, LLC, Carrollton, GA (US)

( * ) Notice: Subject to any disclaimer, the term of this patent is extended or adjusted under 35 U.S.C. 154(b) by 143 days.

(21) Appl. No.: 15/930,203

(22) Filed: May 12, 2020

Related U.S. Application Data

(60) Provisional application No. 62/847,708, filed on May 14, 2019.

(51) Int. Cl.

| | |
|---|---|
| ***B65H 67/052*** | (2006.01) |
| ***B65H 54/44*** | (2006.01) |
| ***B65H 67/04*** | (2006.01) |
| ***B65H 67/06*** | (2006.01) |

(52) U.S. Cl.
CPC ..... *B65H 67/052* (2013.01); *B65H 54/44* (2013.01); *B65H 67/0411* (2013.01); *B65H 67/0417* (2013.01); *B65H 67/061* (2013.01); *B65H 2405/53* (2013.01)

(58) Field of Classification Search
CPC ..... B65H 67/052; B65H 67/061; B65H 67/066–069; B65H 2405/53
See application file for complete search history.

*Primary Examiner* — William E Dondero
(74) *Attorney, Agent, or Firm* — Merchant & Gould P.C.

(57) ABSTRACT

A robotic spooler may be provided. First, a first take-up section of a Capture, Cut, and Transfer (CCT) device may receive a longitudinally continuous material. Then, the CCT device may cause the longitudinally continuous material to be captured by a first spool adjacent to the CCT device, cause the longitudinally continuous material to be taken up onto the first spool, and to provide a first cut to the longitudinally continuous material. Next, the CCT device may transfer the longitudinally continuous material from the first take-up section of the CCT device to a second take-up section of the CCT device. Then the CCT device may cause the longitudinally continuous material to be captured by a second spool adjacent to the CCT device, cause the longitudinally continuous material be taken up onto the second spool, and to provide a second cut to the longitudinally continuous material.

20 Claims, 3 Drawing Sheets

ROBOTIC SPOOLER

CROSS-REFERENCE TO RELATED APPLICATION

This application claims the benefit of U.S. Provisional Patent Application Ser. No. 62/847,708, filed May 14, 2019, which application is hereby incorporated by reference in its entirety.

TECHNICAL FIELD

The present disclosure relates generally to robotic systems. More particularly, the present disclosure relates to robotic systems and methods used in spooling materials.

BACKGROUND

An industrial robot is a robot system used for manufacturing. Industrial robots are automated, programmable, and capable of movement on three or more axis. Most robots are installed in factories or homes, performing labor or life saving jobs. Applications of robots include welding, painting, assembly, pick and place for printed circuit boards, packaging, and labeling. Robotic systems are becoming more desirable to mechanize processes to increase efficiency, to perform more consistent and higher quality work without endangering people.

BRIEF DESCRIPTION OF THE FIGURES

The accompanying drawings, which are incorporated in and constitute a part of this disclosure, illustrate various embodiments of the present disclosure. In the drawings.

DETAILED DESCRIPTION

Overview

Figure 1:
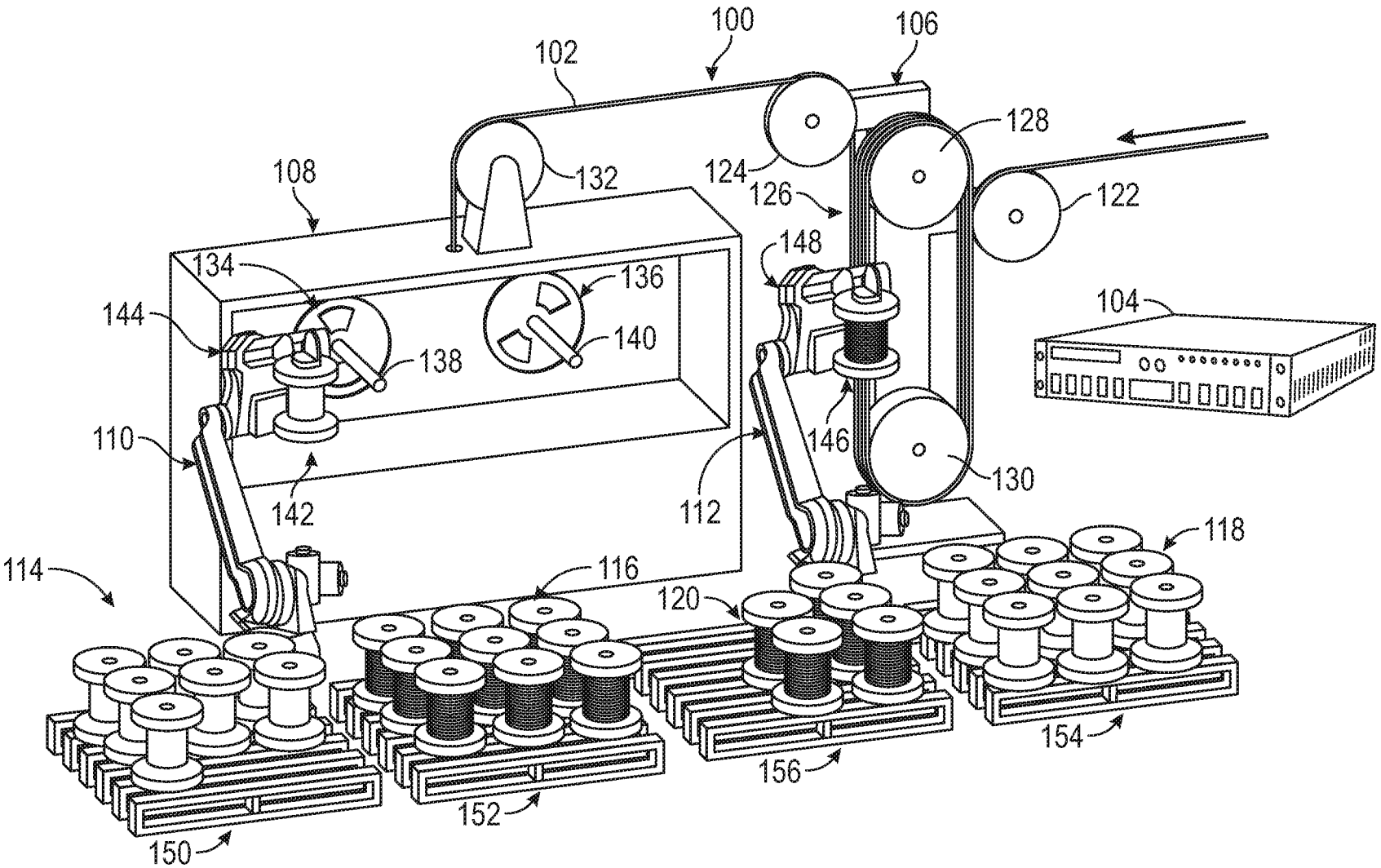
FIG. 1 is a block diagram of a robotic spooling system.

A robotic spooler may be provided. First, a first take-up section of a Capture, Cut, and Transfer (CCT) device may receive a longitudinally continuous material. Then, the CCT device may cause the longitudinally continuous material to be captured by a first spool adjacent to the CCT device, cause the longitudinally continuous material to be taken up onto the first spool, and to provide a first cut to the longitudinally continuous material. Next, the CCT device may transfer the longitudinally continuous material from the first take-up section of the CCT device to a second take-up section of the CCT device. Then the CCT device may cause the longitudinally continuous material to be captured by a second spool adjacent to the CCT device, cause the longitudinally continuous material be taken up onto the second spool, and to provide a second cut to the longitudinally continuous material.

Both the foregoing overview and the following example embodiments are examples and explanatory only, and should not be considered to restrict the disclosure's scope, as described and claimed. Furthermore, features and/or variations may be provided in addition to those described. For example, embodiments of the disclosure may be directed to various feature combinations and sub-combinations described in the example embodiments.

EXAMPLE EMBODIMENTS

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the-disclosed methods. Accordingly, the following detailed description does not limit the disclosure. Instead, the proper scope of the disclosure is defined by the appended claims.

Robots may provide benefits over human labor including improved efficiency, more consistent and higher quality work performed, and the ability to perform hazardous work without endangering people. The degrees of freedom of a robot typically refer to the number of movable joints of a robot. For example, a robot with three movable joints may have three axes and three degrees of freedom, a four axis robot may have four movable joints and four axes, and so on. That is, a three axis robot may pick up an object, lift it, move it horizontally and vertically, and set it down or present it anywhere in the x, y, and z planes within reach of the robot and without changing the object's orientation.

Robots that may move an object anywhere in the x, y, and z planes may have the ability to rotate a part along at least one axis and may be known as four axis robots. That is, a four axis robot may pick up an object, lift it, move it horizontally, and set it down or present it in the x, y, and z planes while changing the object's orientation along one axis.

Embodiments of the disclosure may provide a process to automate spooling operations. Multi-axis robots may be beneficial in providing a reduction in the overall equipment footprint for spooling and palletizing materials.

FIG. 1 is a block diagram of a robotic spooling system 100 consistent with embodiments of the disclosure. Robotic spooling system 100 of FIG. 1 may comprise a longitudinally continuous material 102, a computing device 104, a dancer 106, a Capture, Cut, and Transfer (CCT) device 108, a first robot arm 110, a second robot arm 112, a first plurality of empty spools 114, a first plurality of full spools 116, a second plurality of empty spools 118, and a second plurality of full spools 120.

Dancer 106 may comprise a first dancer wheel 122, a second dancer wheel 124, and a storage section 126. Storage section 126 may include a first pulley 128 and a second pulley 130.

CCT device 108 may comprise a CCT wheel 132, a first take-up section 134, and a second take-up section 136. First take-up section 134 may comprise a first spinal 138, and second take-up section 136 may comprise a second spindle 140. First robot arm 110 may comprise a first spool 142 and a first motor 144. Similarly, second robot arm 112 may comprise a second spool 146 and a second motor 148. First plurality of empty spools 114 may be disposed on a first pallet 150, first plurality of full spools 116 may be disposed on a second pallet 152, second plurality of empty spools 118 may be disposed on a third pallet 154, and second plurality of full spools 120 may be disposed on a fourth pallet 156.

Longitudinally continuous material 102 may comprise, but is not limited to, rope, wire, cable, tubing, hose, or any material that can be placed on a spool. Computing device 104 may comprise, but is not limited to, a Programmable Logic Controller (PLC), a tablet device, a mobile device, a smartphone, a telephone, a remote control device, a set-top box, a personal computer, a network computer, a mainframe, a router, or other similar microcomputer-based device. Computing device 104 may comprise a separate element in system 100 or may be disposed in any one or more of control dancer 106, CCT device 108, first robot arm 110, and second robot arm 112.

Computing device 104 may be practiced in hardware and/or in software (including firmware, resident software, micro-code, etc.) or in any other circuits or systems. Computing device 104 may be practiced in electrical circuits comprising discrete electronic elements, packaged or integrated electronic chips containing logic gates, a circuit utilizing a microprocessor, or on a single chip containing electronic elements or microprocessors. Furthermore, computing device 104 may also be practiced using other technologies capable of performing logical operations such as, for example, AND, OR, and NOT, including but not limited to, mechanical, optical, fluidic, and quantum technologies. As described in greater detail below with respect to FIG. 3, computing device 104 may be practiced in a computer.

Longitudinally continuous material 102 may be looped (e.g., wrapped, spooled, and stored) around first dancer wheel 122 and second dancer wheel 124. Dancer 106 may be configured to apply tension to longitudinally continuous material 102 that may be fed into robotic spooling system 100 to account for any fluctuation in line speed. That is, first dancer wheel 122 and second dancer wheel 124 may be configured to be moved up and down by a mechanical motor or pneumatic air cylinder to achieve the desired tension. Longitudinally continuous material 102, such as wire or cable, may be fed into robotic spooling system 100 directly from an extrusion line.

Dancer 106 may receive longitudinally continuous material 102 prior to first take-up section 134 receiving longitudinally continuous material 102. That is, dancer 106 may provide longitudinally continuous material 102 to CCT device 108. Dancer 106 may have a major function that is to maintain tension and correct for changes in the tension caused by a change in a length of longitudinally continuous material 102. First pulley 128 and second pulley 130 may be symmetric dancer pulleys on either side of longitudinally continuous material 102. When CCT device 108 stops consuming longitudinally continuous material 102, the source that feeds longitudinally continuous material 102 into robotic spooling system 100 does not have to stop because dancer 106 can store up longitudinally continuous material 102. In addition, if the line speed slows down in the robotic spooling system 100, it is not necessary that CCT device 108 slow down because CCT device 108 may use longitudinally continuous material 102 stored on dancer 106.

First robot arm 110 and second robot arm 112 may comprise autonomous multi-axis robots that may comprise at least three axes adapted to move in x, y, and z planes for example. First robot arm 110 and second robot arm 112 may comprise autonomous multi-axis robots that include four axes adapted to move in x, y, and z planes for example.

First robot arm 110 may be configured to capture, lift, carry, and/or support first spool 142. The first robot arm 110 may position first spool 142 adjacent to CCT device 108. Second robot arm 112 may be configured to capture, lift, carry, and/or support second spool 146. The second robot arm 112 may position second spool 146 adjacent to CCT device 108. First robot arm 110 and second robot arm 112 may be configured to respectively place first spool 142 and second spool 146 onto first spindle 138 and second spindle 140. First motor 144 may spin first spool 142 and second motor 148 may spin second spool 146.

Longitudinally continuous material 102 may be received at first take-up section 134 of CCT device 108. Once longitudinally continuous material 102 is received at the first take-up section 134, CCT device 108 may cause longitudinally continuous material 102 to be captured by first spool 142. That is, CCT device 108 may capture a first end (e.g., leading end) of longitudinally continuous material 102 to transfer longitudinally continuous material 102 onto first spool 142 while first spool 142 is suspended and supported by first robot arm 110.

First robot arm 110 may be configured to cause longitudinally continuous material 102 to be taken up (e.g., spooled, wrapped) onto first spool 142. First robot arm 110 may traverse longitudinally continuous material 102 evenly onto first spool 142. In other examples, first robot arm 110 may traverse first spool 142 to evenly wind longitudinally continuous material 102 onto first spool 142. First motor 144 of first robot arm 110 may be actuated to rotate first spool 142 as longitudinally continuous material 102 is taken up onto first spool 142 by the first robot arm 110.

CCT device 108 may provide a first cut to longitudinally continuous material 102 after first robot arm 110 completes first spool 142 as desired. That is, a second end (e.g., trailing end) of longitudinally continuous material 102 may be cut by CCT device 108 such that the first end and the second end of longitudinally continuous material 102 may be secured on first spool 142. First robot arm 110 may remove first spool 142 from being adjacent to CCT device 108 subsequent to the first cut.

First robot arm 110 may be configured to shrink wrap first spool 142 subsequent to the first cut. The shrink wrapping may occur after first spool 142 has been removed from being adjacent to CCT device 108.

First robot arm 110 may be configured to palletize first spool 142 subsequent to the first cut. The shrink wrapping may occur before or after first spool 142 has been palletized. First robot arm 110 in robotic spooling system 100 may continue on to another empty spool after first spool 142 is complete. For example, first plurality of empty spools 114 provided on first pallet 150 may be processed by first robot arm 110 similarly to first spool 142 to provide first plurality of full spools 116 on second pallet 152.

Longitudinally continuous material 102 may be transferred from first take-up section 134 of CCT device 108 to second take-up section 136 of CCT device 108. During the transfer of longitudinally continuous material 102 from first take-up section 134 to second take-up section 136, dancer 106 may accumulate and store longitudinally continuous material 102.

Once longitudinally continuous material 102 is received at second take-up section 136, the CCT device 108 may cause longitudinally continuous material 102 to be captured by second spool 146. That is, CCT device 108 may capture another first end (e.g., leading end) of longitudinally continuous material 102 to transfer longitudinally continuous material 102 onto second spool 146 while second spool 146 is suspended and supported by second robot arm 112.

Second robot arm 112 may cause longitudinally continuous material 102 to be taken up (e.g., spooled, wrapped) onto second spool 146. Second robot arm 112 may traverse longitudinally continuous material 102 evenly onto second spool 146. In other examples, second robot arm 112 may traverse second spool 146 to evenly wind longitudinally continuous material 102 onto second spool 146. Second motor 148 of second robot arm 112 may be actuated to rotate second spool 146 as longitudinally continuous material 102 is taken up onto second spool 146 by second robot arm 112.

CCT device 108 may provide a second cut to longitudinally continuous material 102 after second robot arm 112 completes second spool 146 as desired. That is, another second end (e.g., trailing end) of longitudinally continuous material 102 may be cut by CCT device 108 such that the first end and the second end of longitudinally continuous material 102 may be secured on second spool 146. Second robot arm 112 may remove second spool 146 from being adjacent to CCT device 108 subsequent to the second cut.

Second robot arm 112 may be configured to shrink wrap second spool 146 subsequent to the second cut. The shrink wrapping may occur after second spool 146 has been removed from being adjacent to CCT device 108.

Second robot arm 112 may be configured to palletize second spool 146 subsequent to the second cut. The shrink wrapping may occur before or after second spool 146 has been palletized. Second robot arm 112 in robotic spooling system 100 may continue on to another empty spool after second spool 146 is complete. For example, second plurality of empty spools 118 provided on third pallet 154 may be processed by second robot arm 112 similarly to second spool 146 to provide second plurality of full spools 120 on fourth pallet 156.

In addition to being used in a continuous configuration with a manufacturing line, CCT device 108 may also be used with a stand-alone payoff system. That is, large reels of finished longitudinally continuous material 102 may be processed into smaller length spools on CCT device 108.

Figure 2:
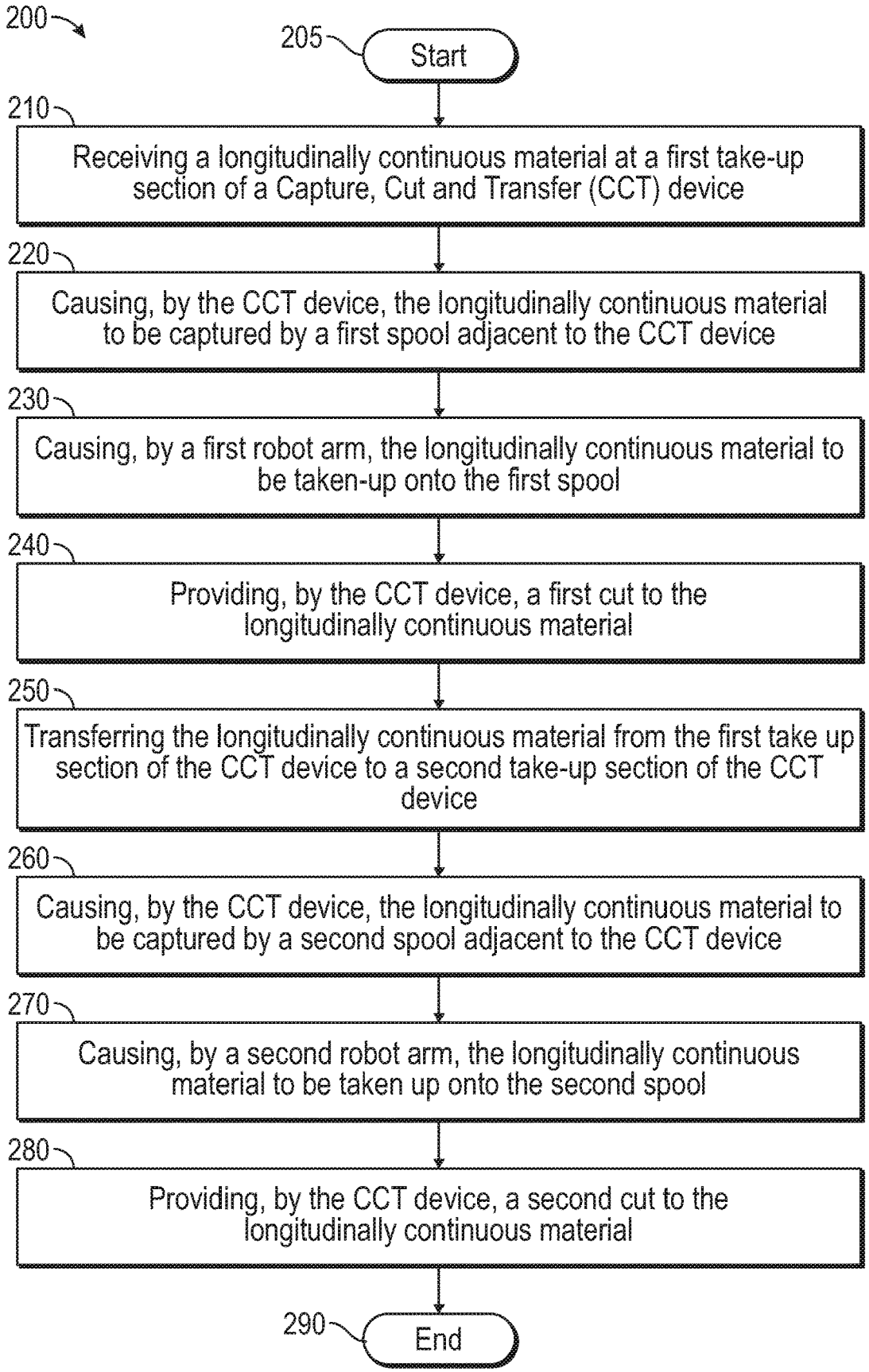
FIG. 2 is a flow chart of a method for providing a robotic spooler.

FIG. 2 is a flow chart setting forth the general stages involved in a method 200 consistent with an embodiment of the disclosure for providing robotic spooling. Method 200 may be implemented using computing device 104 as described above with respect to FIG. 1 and in more detail below with respect to FIG. 3. For example, computing device 104 may control dancer 106, CCT device 108, first robot arm 110, and second robot arm 112 in order to cause robotic spooling system 100 to perform method 200. Ways to implement the stages of method 200 will be described in greater detail below.

Method 200 may begin at starting block 205 and proceed to stage 210 where CCT device 108 may receive longitudinally continuous material 102 at first take-up section 134. For example, longitudinally continuous material 102 may be fed into robotic spooling system 100 as shown in FIG. 1 directly from an extrusion line. Dancer 106 may receive longitudinally continuous material 102 prior to first take-up section 134 receiving longitudinally continuous material 102. That is, dancer 106 may provide longitudinally continuous material 102 to CCT device 108.

From stage 210, where CCT device 108 receives longitudinally continuous material 102 at first take-up section 134, method 200 may advance to stage 220 where CCT device 108 may cause longitudinally continuous material 102 to be captured by first spool 142 adjacent to CCT device 108. For example, CCT device 108 may capture a first end (e.g., leading end) of longitudinally continuous material 102 to transfer longitudinally continuous material 102 onto first spool 142 while first spool 142 is suspended and supported by first robot arm 110.

Once CCT device 108 causes longitudinally continuous material 102 to be captured by first spool 142 adjacent to CCT device 108 in stage 220, method 200 may continue to stage 230 where first robot arm 110 may cause longitudinally continuous material 102 to be taken up onto first spool 142. For example, first robot arm 110 may be configured to cause longitudinally continuous material 102 to be taken up (e.g., spooled, wrapped) onto first spool 142 as shown in FIG. 1. First robot arm 110 may traverse longitudinally continuous material 102 evenly onto first spool 142. First motor 144 of first robot arm 110 may be actuated to rotate first spool 142 as longitudinally continuous material 102 is taken up onto first spool 142 by first robot arm 110.

After first robot arm 110 causes longitudinally continuous material 102 to be taken up onto the first spool 142 in stage 230, the method 200 may proceed to stage 240 where CCT device 108 may provide a first cut to longitudinally continuous material 102. For example, CCT device 108 may provide a first cut to longitudinally continuous material 102 after first robot arm 110 completes first spool 142 as desired. That is, a second end (e.g., trailing end) of longitudinally continuous material 102 may be cut by CCT device 108 such that the first end and the second end of longitudinally continuous material 102 may be secured on first spool 142. First robot arm 110 may remove first spool 142 from being adjacent to CCT device 108 subsequent to the first cut.

From stage 240, where CCT device 109 provides the first cut to longitudinally continuous material 102, method 200 may advance to stage 250 where CCT device 108 may transfer longitudinally continuous material 102 from first take-up section 134 of CCT device 108 to second take-up section 136 of CCT device 108. For example, longitudinally continuous material 102 may be transferred from first take-up section 134 of CCT device 108 to second take-up section 136 of CCT device 108 as shown in FIG. 1. During the transfer of longitudinally continuous material 102 from first take-up section 134 to second take-up section 136, dancer 106 may accumulate and store longitudinally continuous material 102.

Once CCT device 108 transfers longitudinally continuous material 102 from first take-up section 134 of CCT device 108 to second take-up section 136 of CCT device 108 in stage 250, method 200 may continue to stage 260 where CCT device 108 may cause longitudinally continuous material 102 to be captured by second spool 146 adjacent to CCT device 108. For example, CCT device 108 may capture another first end (e.g., leading end) of longitudinally continuous material 102 to transfer longitudinally continuous material 102 onto second spool 146 while second spool 146 is suspended and supported by second robot arm 112 as shown in FIG. 1.

After CCT device 108 causes longitudinally continuous material 102 to be captured by second spool 146 adjacent to CCT device 108 in stage 260, method 200 may proceed to stage 270 where second robot arm 112 may cause longitudinally continuous material 102 to be taken up onto second spool 146. For example, second robot arm 112 may traverse longitudinally continuous material 102 evenly onto second spool 146. Second motor 148 of second robot arm 112 may be actuated to rotate second spool 146 as longitudinally continuous material 102 is taken up onto second spool 146 by second robot arm 112.

From stage 270, where second robot arm 112 causes longitudinally continuous material 102 to be taken up onto second spool 146, method 200 may advance to stage 280 where CCT device 108 may provide a second cut to longitudinally continuous material 102. For example, CCT device 108 may provide a second cut to longitudinally continuous material 102 after second robot arm 112 completes second spool 146 as desired. That is, another second end (e.g., trailing end) of longitudinally continuous material 102 may be cut by CCT device 108 such that the first end and the second end of longitudinally continuous material 102 may be secured on second spool 146. Second robot arm 112 may remove second spool 146 from being adjacent to CCT device 108 subsequent to the second cut. Once CCT device 108 provides the second cut to longitudinally continuous material 102 in stage 280, method 200 may then end at stage 290.

Figure 3:
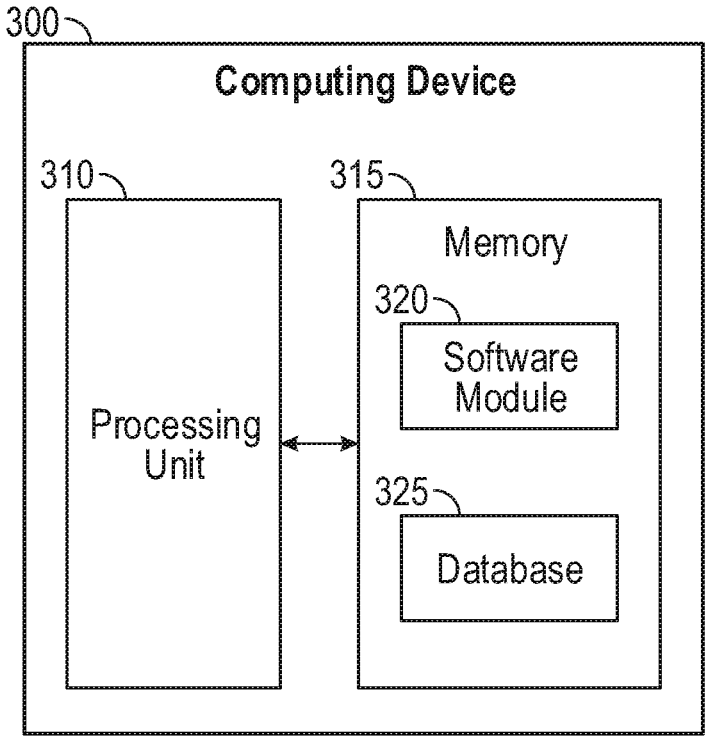
FIG. 3 is a block diagram of a computing device.

FIG. 3 shows computing device 300. As shown in FIG. 3, computing device 300 may include a processing unit 310 and a memory unit 315. Memory unit 315 may include a software module 320 and a database 325. While executing on processing unit 310, software module 320 may perform, for example, processes for providing robotic spooling, including for example, any one or more of the stages from method 200 described above with respect to FIG. 2.

Computing device 300 may be implemented using a PLC, a tablet device, a mobile device, a smart phone, a telephone, a remote control device, a set-top box, a digital video recorder, a cable modem, a personal computer, a network computer, a mainframe, a router, a switch, a server cluster, a smart TV-like device, a network storage device, a network relay devices, or other similar microcomputer-based device. Computing device 300 may comprise any computer operating environment, such as hand-held devices, multiprocessor systems, microprocessor-based or programmable sender electronic devices, minicomputers, mainframe computers, and the like. Computing device 300 may also be practiced in distributed computing environments where tasks are performed by remote processing devices. The aforementioned systems and devices are examples and computing device 300 may comprise other systems or devices.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example, but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the disclosure.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including, but not limited to, mechanical, optical, fluidic, and quantum technologies. In addition, embodiments of the disclosure may be practiced within a general purpose computer or in any other circuits or systems.

Embodiments of the disclosure may be practiced via a system-on-a-chip (SOC) where each or many of the components illustrated in FIG. 1 may be integrated onto a single integrated circuit. Such an SOC device may include one or more processing units, graphics units, communications units, system virtualization units and various application functionality all of which may be integrated (or "burned") onto the chip substrate as a single integrated circuit. When operating via an SOC, the functionality described herein with respect to embodiments of the disclosure, may be performed via application-specific logic integrated with other components of computing device 300 on the single integrated circuit (chip).

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. A method comprising:

receiving a longitudinally continuous material at a first take-up section of a Capture, Cut, and Transfer (CCT) device;

causing, by the CCT device, the longitudinally continuous material to be captured by a first spool adjacent to the CCT device;

causing, by a first robot arm, the longitudinally continuous material to be taken up onto the first spool;

providing, by the CCT device, a first cut to the longitudinally continuous material;

transferring the longitudinally continuous material from the first take-up section of the CCT device to a second take-up section of the CCT device;

causing, by the CCT device, the longitudinally continuous material to be captured by a second spool adjacent to the CCT device;

causing, by a second robot arm, the longitudinally continuous material to be taken up onto the second spool; and providing, by the CCT device, a second cut to the longitudinally continuous material.

2. The method of claim 1, further comprising:

receiving, at a dancer, the longitudinally continuous material prior to receiving the longitudinally continuous material at the first take-up section of the CCT device; and providing, by the dancer to the CCT device, the longitudinally continuous material.

3. The method of claim 2, further comprising:

storing, by the dancer, the longitudinally continuous material, during transferring the longitudinally continuous material from the first take-up section of the CCT device to the second take-up section of the CCT device.

4. The method of claim 1, further comprising:

capturing, by the first robot arm, the first spool;

placing, by the first robot arm, the first spool adjacent to the CCT device; and removing, by the first robot arm, the first spool from being adjacent to the CCT device subsequent to the first cut.

5. The method of claim 1, further comprising:

capturing, by the second robot arm, the second spool;

placing, by the second robot arm, the second spool adjacent to the CCT device; and removing, by the second robot arm, the second spool from being adjacent to the CCT device subsequent to the second cut.

6. The method of claim 1, wherein causing, by the first robot arm, the longitudinally continuous material to be taken up onto the first spool further comprises actuating a first motor on the first robot arm to rotate the first spool.

7. The method of claim 1, wherein causing, by the second robot arm, the longitudinally continuous material to be taken up onto the second spool further comprises actuating a second motor on the second robot arm to rotate the second spool.

8. A system comprising:

a memory storage; and a processing unit disposed in a computing device and coupled to the memory storage, wherein the processing unit is operative to control a Capture, Cut, and Transfer (CCT) device, a first robot arm, and a second robot arm in order to:

cause the CCT device to receive a longitudinally continuous material at a first take-up section of the CCT device;

cause, by the CCT device, the longitudinally continuous material to be captured by a first spool adjacent to the CCT device;

cause, by the first robot arm, the longitudinally continuous material to be taken up onto the first spool;

provide, by the CCT device, a first cut to the longitudinally continuous material, transfer the longitudinally continuous material from the first take-up section of the CCT device to a second take-up section of the CCT device;

cause, by the CCT device, the longitudinally continuous material to be captured by a second spool adjacent to the CCT device;

cause, by the second robot arm, the longitudinally continuous material to be taken up onto the second spool; and provide, by the CCT device, a second cut to the longitudinally continuous material.

9. The system of claim 8, wherein the processing unit is further operative to control a dancer in order to cause the dancer to:

receive the longitudinally continuous material prior to receiving the longitudinally continuous material at the first take-up section of the CCT device; and provide, to the CCT device, the longitudinally continuous material.

10. The system of claim 9, wherein the processing unit is further operative to cause the dancer to store the longitudinally continuous material during the transfer of the longitudinally continuous material from the first take-up section of the CCT device to the second take-up section of the CCT device.

11. The system of claim 8, wherein the processing unit is further operative to cause the first robot arm to:

capture the first spool;

place the first spool adjacent to the CCT device; and remove the first spool from being adjacent to the CCT device subsequent to the first cut.

12. The system of claim 8, wherein the processing unit is further operative to cause the second robot arm to:

capture the second spool;

place the second spool adjacent to the CCT device; and remove the second spool from being adjacent to the CCT device subsequent to the second cut.

13. The system of claim 8, wherein the processing unit being operative to cause, by the first robot arm, the longitudinally continuous material to be taken up onto the first spool further comprises the processing unit being operative to actuate a first motor on the first robot arm to rotate the first spool, and wherein the processing unit being operative to cause, by the second robot arm, the longitudinally continuous material to be taken up onto the second spool further comprises the processing unit being operative to actuate a second motor on the second robot arm to rotate the second spool.

14. A non-transitory computer-readable medium that stores a set of instructions which, when executed, perform a method executed by the set of instructions comprising:

receiving a longitudinally continuous material at a first take-up section of a Capture, Cut, and Transfer (CCT) device;

causing, by the CCT device, the longitudinally continuous material to be captured by a first spool adjacent to the CCT device;

causing, by a first robot arm, the longitudinally continuous material to be taken up onto the first spool;

providing, by the CCT device, a first cut to the longitudinally continuous material;

transferring the longitudinally continuous material from the first take-up section of the CCT device to a second take-up section of the CCT device;

causing, by the CCT device, the longitudinally continuous material to be captured by a second spool adjacent to the CCT device;

causing, by a second robot arm, the longitudinally continuous material to be taken up onto the second spool; and providing, by the CCT device, a second cut to the longitudinally continuous material.

15. The non-transitory computer-readable medium of claim 14, further comprising:

receiving, at a dancer, the longitudinally continuous material prior to receiving the longitudinally continuous material at the first take-up section of the CCT device; and providing, by the dancer to the CCT device, the longitudinally continuous material.

16. The non-transitory computer-readable medium of claim 15, further comprising:

storing, by the dancer, the longitudinally continuous material, during transferring the longitudinally continuous material from the first take-up section of the CCT device to the second take-up section of the CCT device.

17. The non-transitory computer-readable medium of claim 14, further comprising:

capturing, by the first robot arm, the first spool;

placing, by the first robot arm, the first spool adjacent to the CCT device; and removing, by the first robot arm, the first spool from being adjacent to the CCT device subsequent to the first cut.

18. The non-transitory computer-readable medium of claim 14, further comprising:

capturing, by the second robot arm, the second spool;

placing, by the second robot arm, the second spool adjacent to the CCT device; and removing, by the second robot arm, the second spool from being adjacent to the CCT device subsequent to the second cut.

19. The non-transitory computer-readable medium of claim 14, wherein causing, by the first robot arm, the longitudinally continuous material to be taken up onto the first spool further comprises actuating a first motor on the first robot arm to rotate the first spool.

20. The non-transitory computer-readable medium of claim 14, wherein causing, by the second robot arm, the longitudinally continuous material to be taken up onto the second spool further comprises actuating a second motor on the second robot arm to rotate the second spool.

* * * * *